US009897288B2

(12) United States Patent
Sorensen et al.

(10) Patent No.: US 9,897,288 B2
(45) Date of Patent: Feb. 20, 2018

(54) REMOVABLE LOUVER OR LENS HOLDER FOR A CEILING SUPPORT GRID AND METHOD OF USE

(71) Applicant: Litetronics International, Inc., Harvey, IL (US)

(72) Inventors: Robert Sorensen, Harvey, IL (US); Raghu Rao, Romeoville, IL (US)

(73) Assignee: Litetronics International, Inc., Bedford Park, IL (US)

( * ) Notice: Subject to any disclaimer, the term of this patent is extended or adjusted under 35 U.S.C. 154(b) by 0 days.

(21) Appl. No.: 15/181,171

(22) Filed: Jun. 13, 2016

(65) Prior Publication Data

US 2017/0356625 A1 Dec. 14, 2017

(51) Int. Cl.

| | |
|---|---|
| ***F21S 8/04*** | (2006.01) |
| ***F21V 11/02*** | (2006.01) |
| ***E04B 9/00*** | (2006.01) |
| ***F21V 17/06*** | (2006.01) |
| ***F21V 17/18*** | (2006.01) |

(52) U.S. Cl.

CPC ..... *F21V 11/02* (2013.01); *E04B 9/006* (2013.01); *F21S 8/04* (2013.01); *F21V 17/06* (2013.01); *F21V 17/18* (2013.01)

(58) Field of Classification Search

CPC ..... E04B 9/006; E04B 9/064–9/068; E04B 9/241; E04B 9/242; F21V 17/06; F21V 17/107; F21V 17/18; F21V 21/025; F21V 21/04–21/049; F21V 11/02; F21S 8/026; F21S 8/028; F21S 8/04; F21S 8/043

See application file for complete search history.

(56) References Cited

U.S. PATENT DOCUMENTS

| | | | | |
|---|---|---|---|---|
| 2,852,663 | A * | 9/1958 | Stuffer | F21V 17/101 292/145 |
| 2,961,530 | A * | 11/1960 | Garnett | F21S 8/02 362/311.03 |
| 3,308,288 | A * | 3/1967 | Ades | E04B 9/006 362/150 |
| 2009/0196024 | A1* | 8/2009 | Heiking | F21S 8/026 362/150 |
| 2010/0142202 | A1* | 6/2010 | Sugishita | F21S 8/026 362/235 |

* cited by examiner

*Primary Examiner* — Anh Mai
*Assistant Examiner* — Steven Horikoshi
(74) *Attorney, Agent, or Firm* — Witters & Associates; Steve Witters

(57) ABSTRACT

Technologies are described for a louver or lens holder having a rectangular or square frame with parallel first side edge and a second side edges. At least one extension extends from the first side edge and at least one retractable support arm is configured to be extended from, and retracted into, the second side edge. The louver or lens holder is configured to be inserted into a ceiling support grid and to be held therewith.

20 Claims, 8 Drawing Sheets

REMOVABLE LOUVER OR LENS HOLDER FOR A CEILING SUPPORT GRID AND METHOD OF USE

FIELD OF THE DISCLOSURE

This invention generally relates to a louver or lens holders for holding a louver or lens to a ceiling support grid, such as a false ceiling having ceiling tiles supported with a ceiling support grid.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Ceiling support grids and ceiling panels are very common in the office buildings where ceilings are constructed over open floor plan interior designs, such as cubicles. Such ceiling are popular in other commercial, industrial and domestic environments, including and not limited to hotels, meeting rooms, recreation rooms and other types of rooms or constructions which require removable ceilings for access to utilities (heating, air conditioning, water) that are concealed in the space between the drop ceiling tiles and the structural ceiling of the room. Such ceiling systems are well suited for use in old office buildings with high ceilings and with ceilings that are curved or arched. Typically, ceiling panels may be installed from beneath the ceiling support grid.

It is often desired to place luminaires or troffers on the ceiling support grid. Luminaires are typically installed to provide light through the ceiling support grid.

SUMMARY

In at least one embodiment of the present disclosure, a removable louver or lens holder, configured for holding a removable louver or lens to a ceiling support grid, is disclosed. The removable louver or lens holder has a rectangular or square frame having a first side with a first side edge and a second side with a second side edge. The first side edge and the second side edge are parallel with one another. At least one tab extends from the first side edge and at least one locking mechanism is configured to be extended from and retracted into the second side edge. The at least one tab is configured and disposed to cooperate with the ceiling support grid and removably hold the first side edge with the ceiling support grid. The at least one locking mechanism is configured for passing the removable louver or lens holder into the ceiling support grid, upon the at least one tab being cooperated with the ceiling support grid and the at least one locking mechanism being in the retracted position. The at least one locking mechanism is configured for holding the removable louver or lens holder with the ceiling support grid upon the at least one tab being cooperated with the ceiling support grid and the at least one locking mechanism being in the extended position.

In at least one other embodiment of the present disclosure, a method for installing a lens or louver with a ceiling support grid is disclosed. The method comprises laying at least one tab, extending from a first side of the lens or louver, on the ceiling support grid and pivoting the lens or louver about the at least one tab and placing it substantially within a plane of the ceiling support grid. At least one support arm is extended outwardly from a second side of the lens or louver and laid on the ceiling support grid and thereby holding the lens or louver with the ceiling support grid.

In at least one additional embodiment of the present disclosure, a louver or lens holder configured to solely hold a louver or lens to a ceiling support grid is disclosed. The louver or lens holder is configured to transform its outer perimeter from a first outer perimeter to a second outer perimeter, wherein the first outer perimeter enables the louver or lens holder to fit into the ceiling support grid and the second outer perimeter enables the louver or lens holder to be held solely with the ceiling support grid.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are, therefore, not to be considered limiting of its scope, the disclosure will be described with additional specificity and detail through use of the following figures, which are idealized, are not to scale and are intended to be merely illustrative of aspects of the present disclosure and non-limiting. In the drawings, like elements are depicted by like reference numerals. The drawings are briefly described as follows:

DETAILED DESCRIPTION

Figure 1:
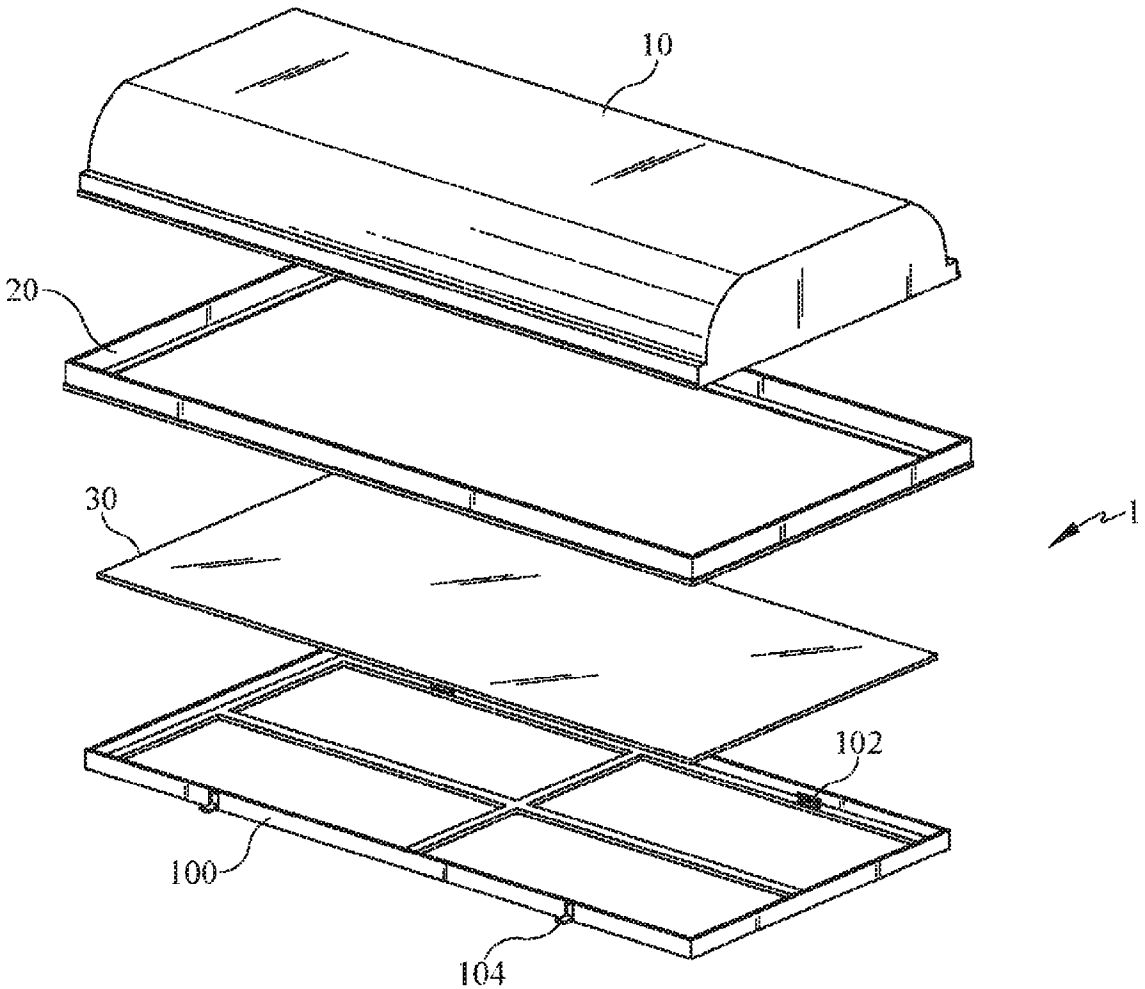
FIG. 1 is a perspective exploded view of a lighting system having the removable louver or lens holder of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This present disclosure addresses issues associated with ceiling support grid lighting systems. A ceiling support grid lighting system may comprise a luminaire, a removable louver or lens holder, and a removable louver or lens. The luminaire may have a troffer with one or more tube lamps, such as LED tube lamps, held therein. The luminaire may be placed on the ceiling support grid to have the light from the lamps directed downward through a space in the ceiling support grid having a ceiling panel removed. A lens, such as a diffusing lens or diffuser, or louver may be placed about the light opening in the ceiling support grid. In at least one embodiment of the present disclosure, a louver or lens holder is configured to solely hold a louver or lens to a ceiling support grid. For example, the louver or lens holder is not held to or with a luminaire or troffer, but solely held to a ceiling support grid.

Embodiments of the present disclosure provide a lens or removable louver holder that enables easy, or less laborious, installation and removal of a lens or louver. In at least one embodiment of the present disclosure, a removable louver or lens holder is provided that enables ease of installation and removal of the lens or louver and access to the luminaire. The removable louver or lens holder may have one or more tabs extending from one edge and one or more locking mechanisms configured and disposed to extend an arm out of the opposite edge of the removable louver or lens holder.

The removable louver or lens may be installed by placing a removable louver or lens in the removable louver or lens holder and cooperating at least one tab extending from a first side edge of the removable louver or lens holder with the ceiling support grid and pivoting the removable louver or lens holder about the at least one tab and placing a second edge of the removable louver or lens holder in or above a plane of the ceiling support grid. The locking mechanism(s) may then be activated to extend a portion of the locking mechanism outwardly to cooperate with the ceiling support grid and hold the removable louver or lens to the ceiling support grid. For example, the tabs and locking mechanisms may have portions extending outwardly between a luminaire and ceiling support grid. The removable louver or lens holder may be easily removed by retracting the extended portion of the locking mechanism from the ceiling support grid and swinging or pivoting the removable louver or lens downward and then sliding the tabs out of the ceiling support grid.

When the removable louver or lens is installed, the tabs and extended portions of the locking mechanisms may reside between the luminaire or troffer and ceiling support grid. In this example, the weight of the luminaire may further hold the removable louver or lens, held with the removable louver or lens holder, on the ceiling support grid. This may mitigate unwanted removal of the removable louver or lens from the ceiling support grid and may prevent damage and injury from falling louvers or lenses. For example, if the removable louver or lens is inadvertently hit or the building is shaken by an earth tremor, the removable louver or lens may resist becoming dislodged from the ceiling panel ceiling support grid and fall upon and injure people or damage property.

FIG. 1 is a perspective exploded view of a lighting system 1 having a removable louver or lens holder 100 of the present disclosure. Lighting system 1 may be configured for installing with a ceiling support grid 20. Lighting system 1 may have a luminaire 10, a removable louver or lens 30, and a removable louver or lens holder 100. Louver or lens holder 100 may be configured for removably holding louver or lens 30 to ceiling support grid 20.

Figure 2:
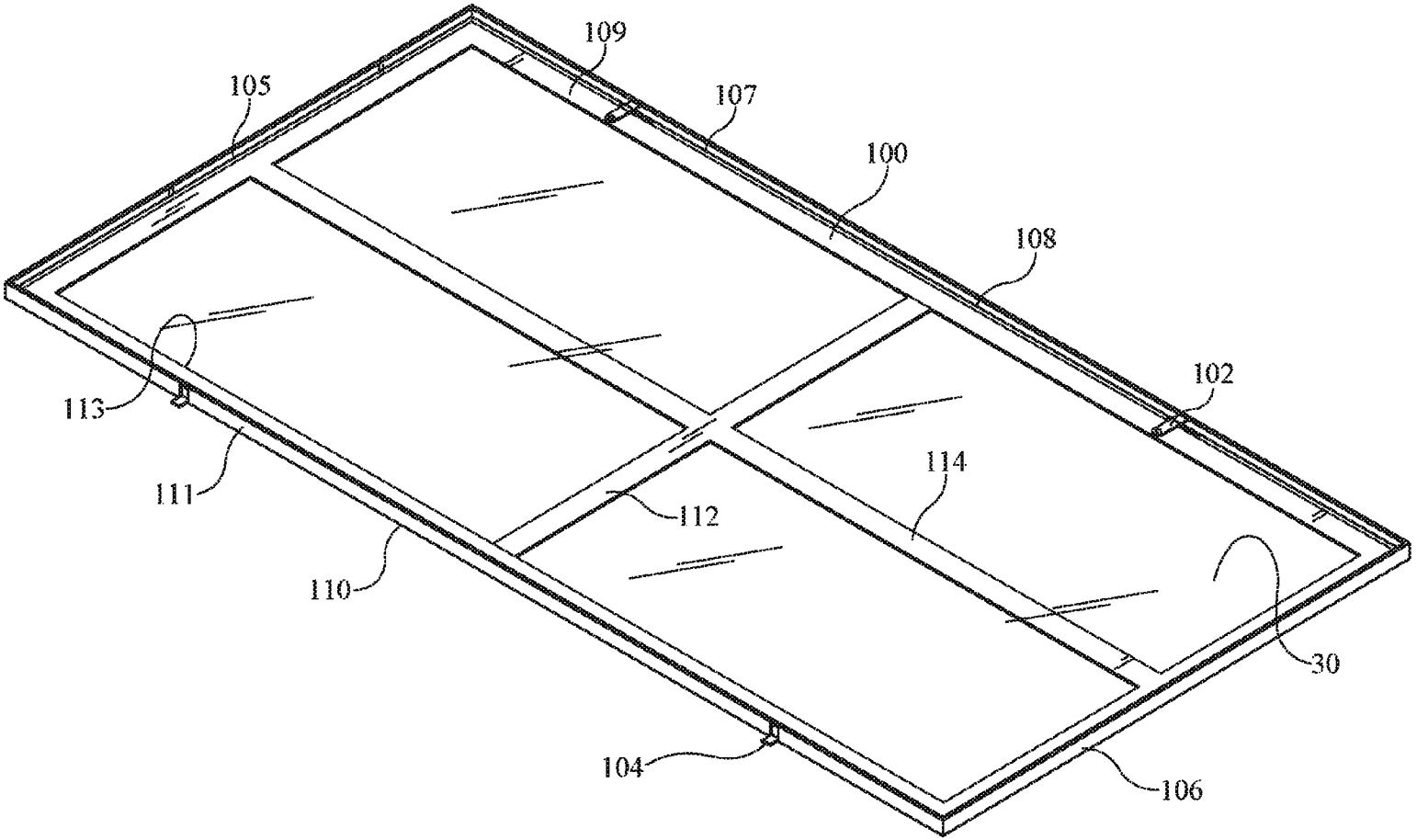
FIG. 2 is a perspective view of the removable louver or lens holder shown in FIG. 1.

FIG. 2 shows a perspective view of removable louver or lens holder 100. As shown in FIG. 2, removable louver or lens holder 100 may comprise a rectangular or square frame having a first side 110 with a first side edge 111 and a second side 108 with a second side edge 107. A third side 105 and a fourth side 106 may extend between first and second sides 110 and 108. First side 110 may have a portion extending inwardly, 113, from first side edge 111 and second side 108 may have a portion extending inwardly, 109, from second side edge 107. Third and fourth sides 105 and 106 may be similarly configured and have the same cross-sections as first and second sides 110 and 108.

In at least one illustrative example, each side edge, for example 107 and 111, may extend perpendicularly to a louver or lens and may be configured to extend into troffer or luminaire 10 and prevent light leakage between louver or lens holder 100 and luminaire or troffer 10. In at least one other illustrative example, inwardly extending portions 109 and 113 are configured and disposed to become flush with ceiling support grid 20 upon louver or lens holder 100 being held with ceiling support grid 20.

In at least one other illustrative example, louver or lens holder 100 is configured to solely hold louver or lens 30 to ceiling support grid 20. For example, louver or lens holder 100 may be held with ceiling support grid 20 only, in the absence of luminaire or troffer 10.

First side edge 111 and the second side edge 107 are parallel with one another. At least one extension, for example tab 104, extends from the first side edge 111. At least one locking mechanism 102 has a portion configured to be extended from, and retracted into, second side edge 107. At least one tab 104 may be configured and disposed to cooperate with, or lay upon, ceiling support grid 20 and removably hold first side 110 with the ceiling support grid 20.

Figure 3:
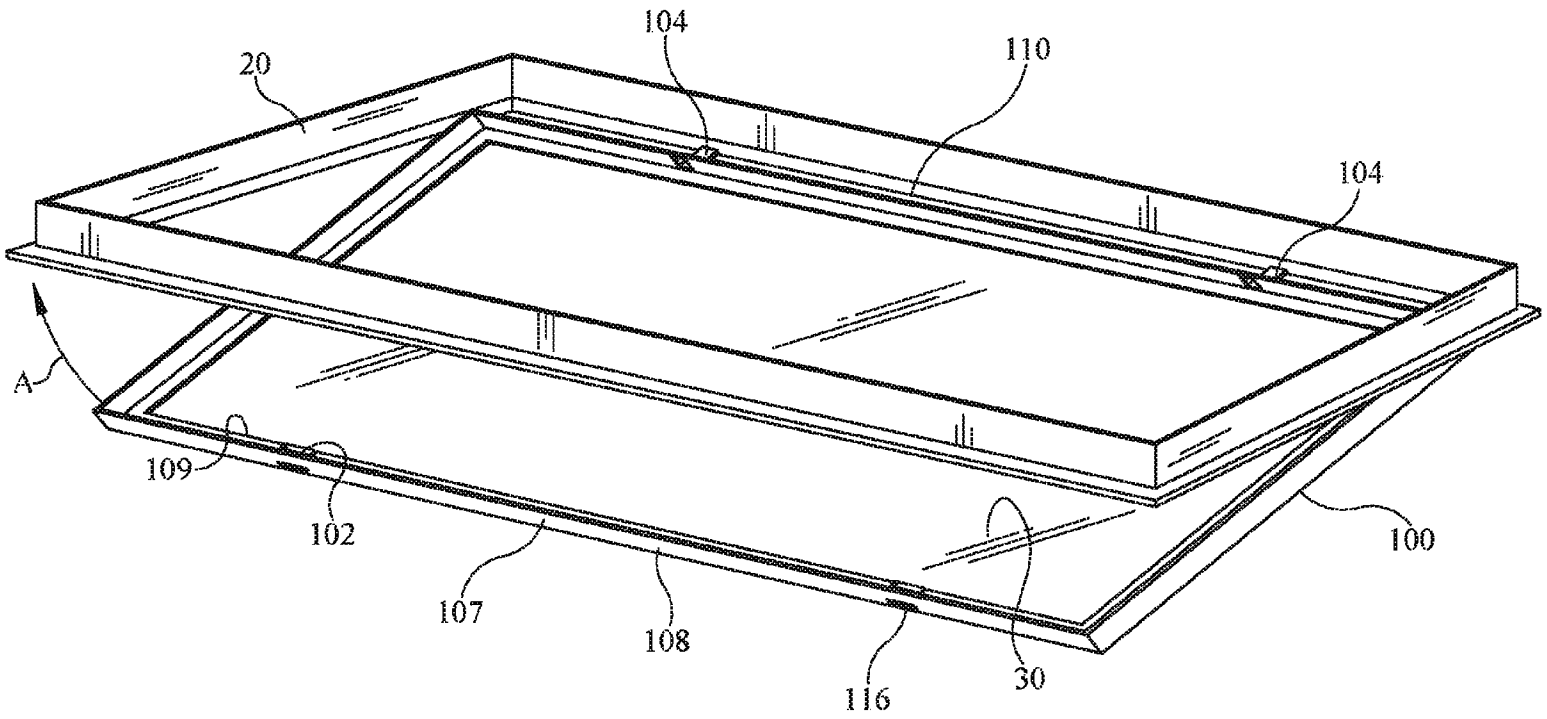
FIG. 3 is a perspective view of the removable louver or lens holder, shown in FIG. 1, having a first side in cooperation with a ceiling support grid.
Figure 4:
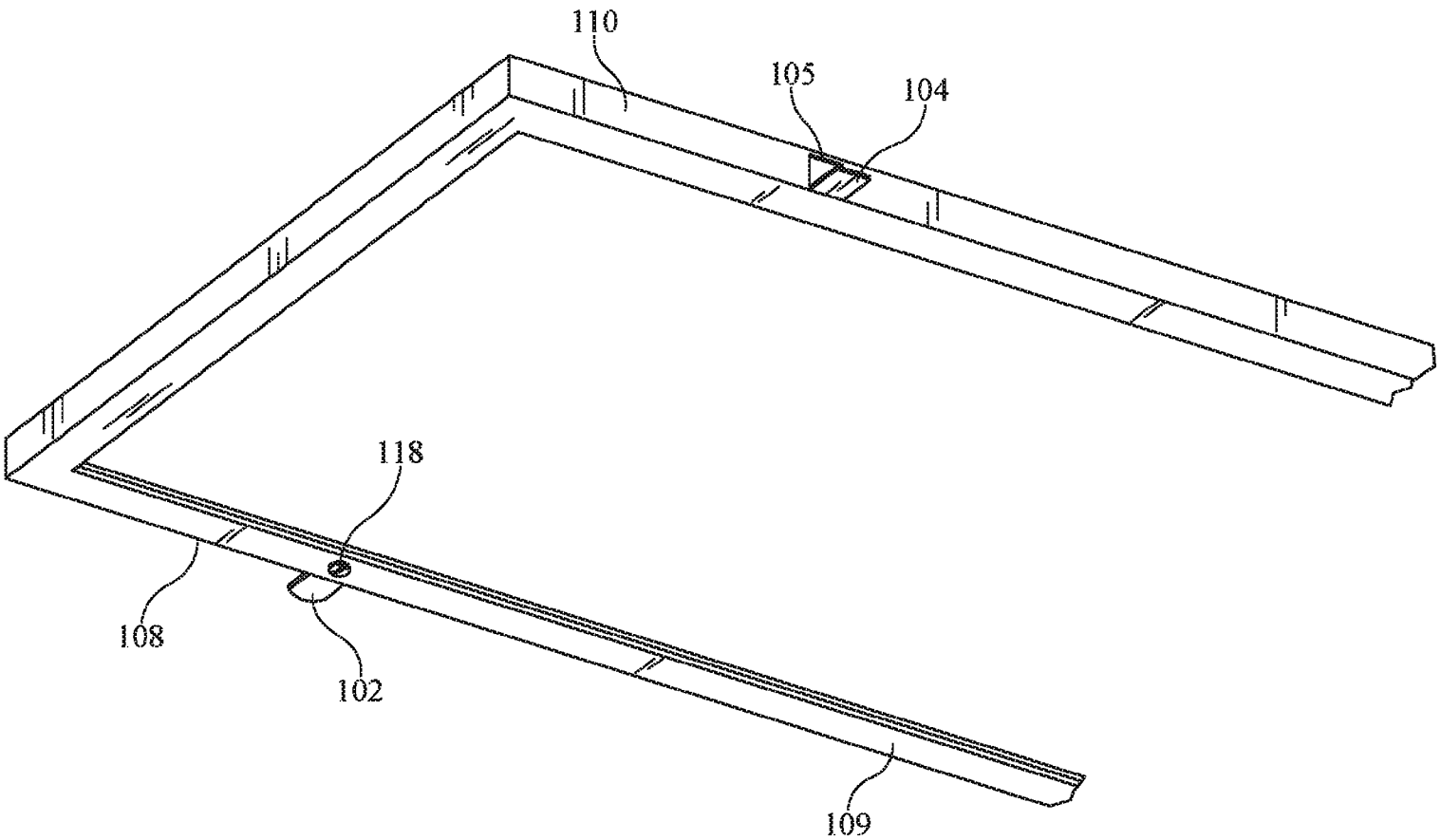
FIG. 4 is a perspective view of a portion of the removable louver or lens holder, shown in FIG. 1, having a locking mechanism in an extended position.
Figure 7:
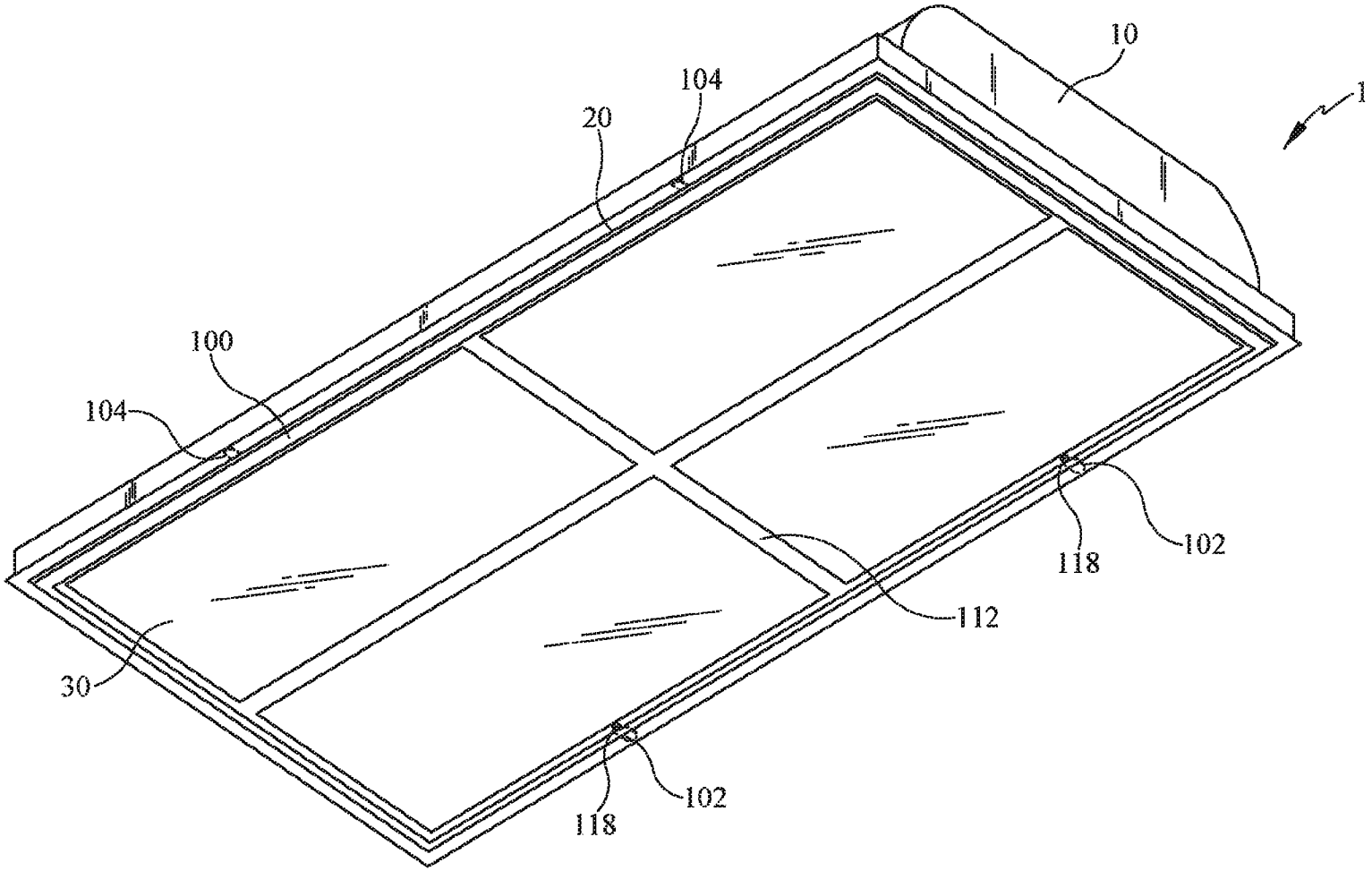
FIG. 7 is a lower perspective view of the lighting system shown in FIG. 1 having the removable louver or lens holder of the present disclosure installed with the ceiling support grid and luminaire.

The at least one locking mechanism 102 may be configured for passing removable louver or lens holder 100 into ceiling support grid 20, upon the at least one tab 104 being cooperated with ceiling support grid 20 and the at least one locking mechanism 102 being in the retracted position, as shown in FIG. 3. The at least one locking mechanism 102 may be configured for holding removable louver or lens holder 100 with the ceiling support grid 20 upon at least one tab 104 being cooperated with, or laid upon, ceiling support grid 20 and the at least one locking mechanism 102 being in the extended position, as shown in FIGS. 4 and 7. For example, portions of tabs 104 and extended locking mechanism 102 may lie on portions of ceiling support grid 20.

It is to be understood that louver or lens holder 100 may have a plurality of locking mechanisms 102, spaced about its perimeter. Placement of selected locking mechanisms 102 in a retracted position may provide louver or lens holder 100 with a first perimeter that may enable louver or lens holder 100 to be placed into ceiling support grid 20. Upon placing louver or lens holder 100 into ceiling support grid 20, placement of selected locking mechanisms in an extended position may provide louver or lens holder 100 with a second perimeter that may enable louver or lens holder 100 to be held with ceiling support grid 20.

Removable louver or lens holder 100 may have at least one cross-member 112 extending from its first side 110 to its second side 108 which may provide additional support for louver or lens 30. Additional cross-members, such as cross-members 114, may also be disposed with removable louver or lens holder 100. The cross-members may provide an aesthetic design about a lower surface of louver or lens 30.

FIG. 3 shows a perspective view of removable louver or lens holder 100 having a first side 110 in cooperation with, or lying on, ceiling support grid 20. Tabs 104 are extended onto a lip of ceiling support grid 20, cooperating first side 110 with ceiling support grid 20. Locking mechanisms 102 are in a retracted position, retracted within an outer perimeter of removable louver or lens holder 100. In this configuration, removable louver or lens holder 100 may be configured with an outer perimeter that may enable it to be placed into ceiling support grid 20 by moving, or pivoting, second side 108 up into ceiling support grid 20, as designated with arrow "A".

FIG. 4 shows a perspective view of a portion of removable louver or lens holder 100 having a locking mechanism 102 in an extended position. Upon moving second side 108 up into ceiling support grid 20, locking mechanism 102 may be placed into the extended position wherein a portion thereof extends outwardly from second side edge 107 and may cooperate with ceiling support grid 20. Also shown in FIG. 4 is an embodiment of tab 104 formed with a punch out 105 of second side edge 111.

Figure 5:
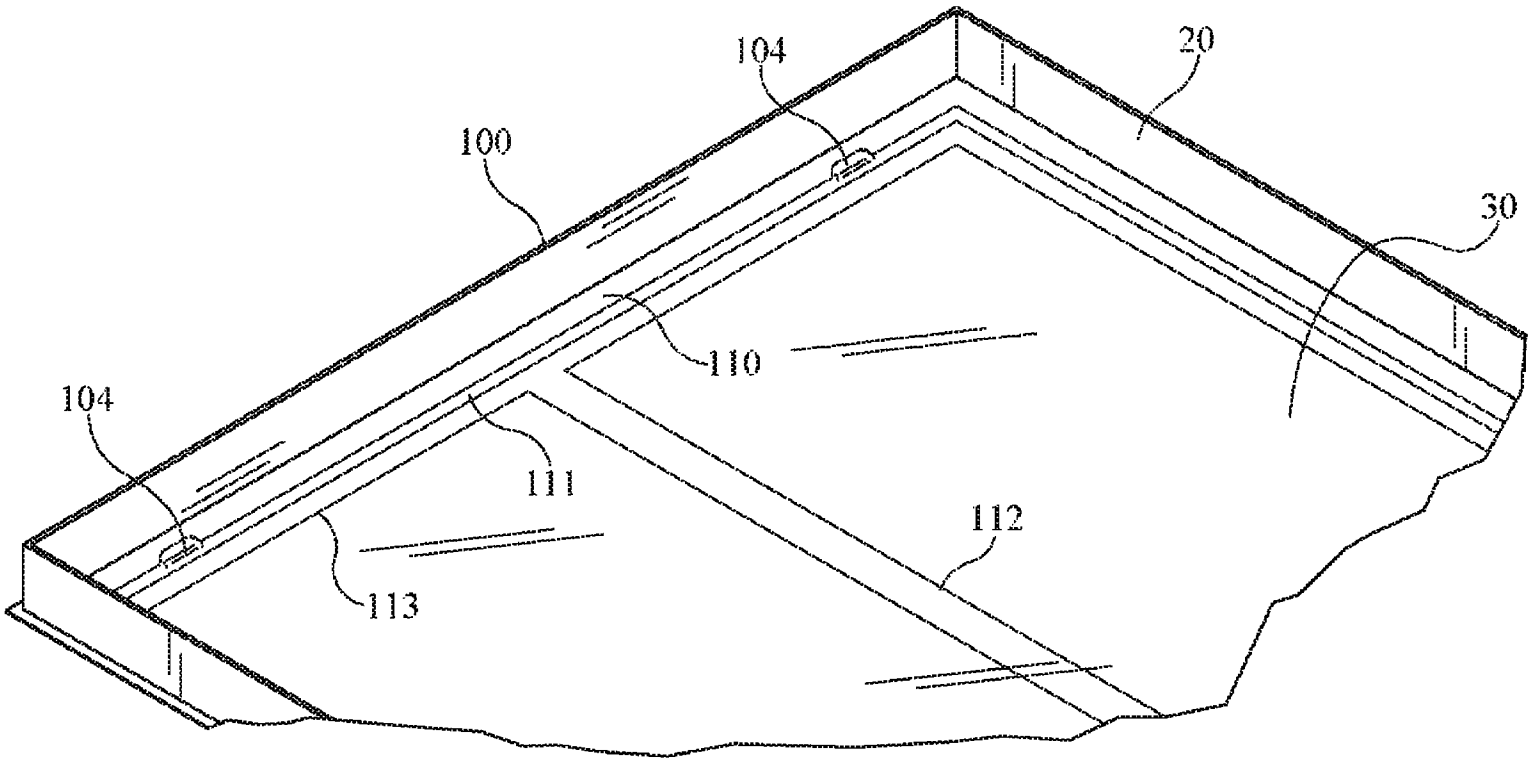
FIG. 5 is an upper perspective view of a portion of the removable louver or lens holder, shown in FIG. 1, having a first edge in cooperation with a ceiling support grid.

FIG. 5 is an upper perspective view of a portion of removable louver or lens holder 100 having first side edge 111 in cooperation with, or lying on, ceiling support grid 20. Installation of removable louver or lens holder 100 with ceiling support grid 20 may be performed by placing tabs 104, extending from side edge 111, onto a portion of ceiling support grid 20.

Figure 6:
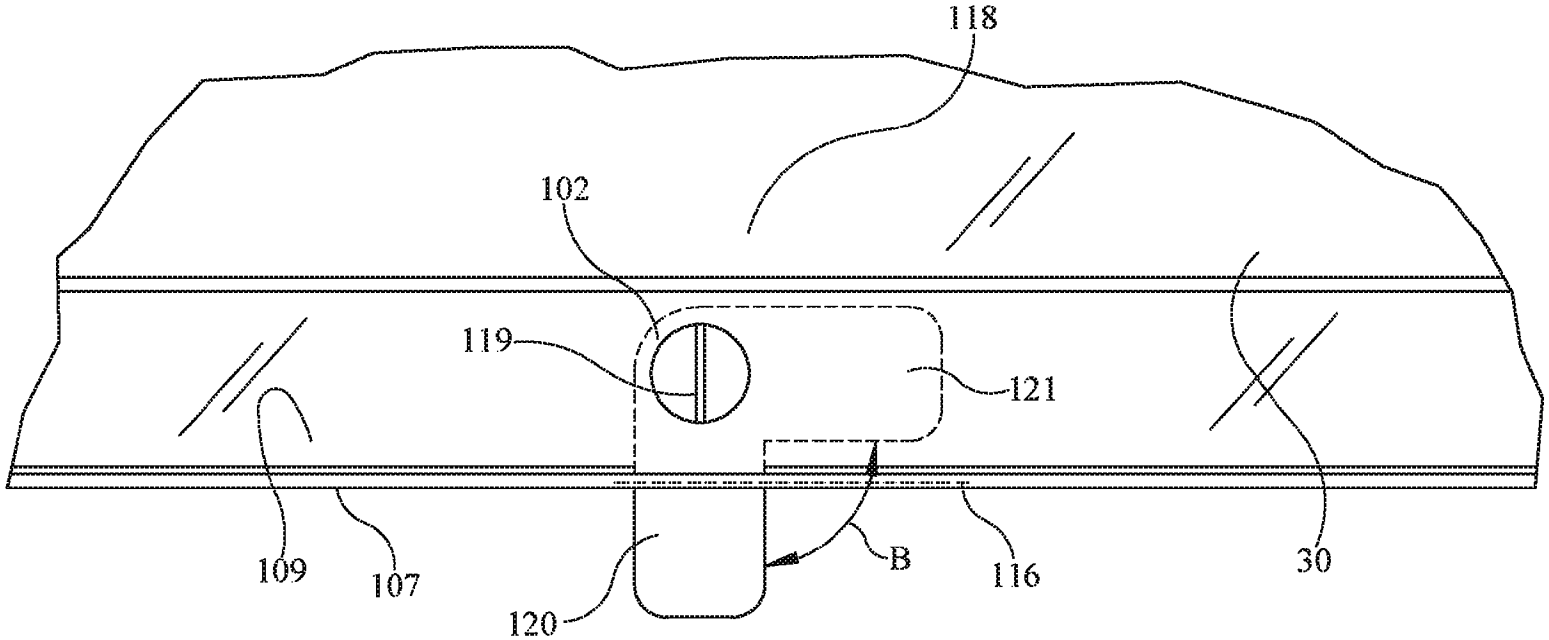
FIG. 6 shows an embodiment of a locking mechanism of the present disclosure.

FIG. 6 shows an embodiment of a locking mechanism 102 of the present disclosure. Locking mechanism 102 may comprise a retractable support arm 120 configured to extend into and out of a slot opening 116 in second side edge 107. For example, locking mechanism 102 may comprise a shaft 118 extending from retractable support arm 120 and through a leg extending inwardly 109 from the second side edge 107. Shaft 118 may have a slot 119 in the end extending through the inwardly extending leg 109 and may be configured to be rotated and to rotate retractable support arm 120 into and out of the extended position. Retractable support arm 121 is shown to designate retractable support arm 120 rotated into a retracted position. For example, a screw driver may be used to cooperate with slot 119 and rotate retractable support arm 120 into an extended position to cooperate with ceiling support grid 20.

In at least one illustrative example, louver or lens holder 100 is configured to transform its outer perimeter from a first outer perimeter to a second outer perimeter. For example, retracting support arm(s) 120 may configure louver or lens holder 100 with a first outer perimeter and enable louver or lens holder 100 to fit into ceiling support grid 20. Extending support arm(s) 120 may configure louver or lens holder 100 with a second outer perimeter and enable louver or lens holder 100 to be held solely with ceiling support grid 20.

FIG. 7 shows a lower perspective view of lighting system 1 having removable louver or lens holder 100 installed with ceiling support grid 20 and luminaire 10. Lighting system 1 may have luminaire 10 with a troffer configured with edges configured and disposed to be placed upon tabs 104 and portions of locking mechanisms 102 which may provide vertical support for removable louver or lens holder 100. As shown in FIG. 7, upon installation of lighting system 1, shafts 118 are accessible, providing a means for rotating retractable support arms 120 and removal of removable louver or lens holder 100. Luminaire 10 may have a troffer configured with edges configured and disposed to be placed upon 104 tabs and portions, or support arms 120, of the locking mechanism 102.

Figure 8A:
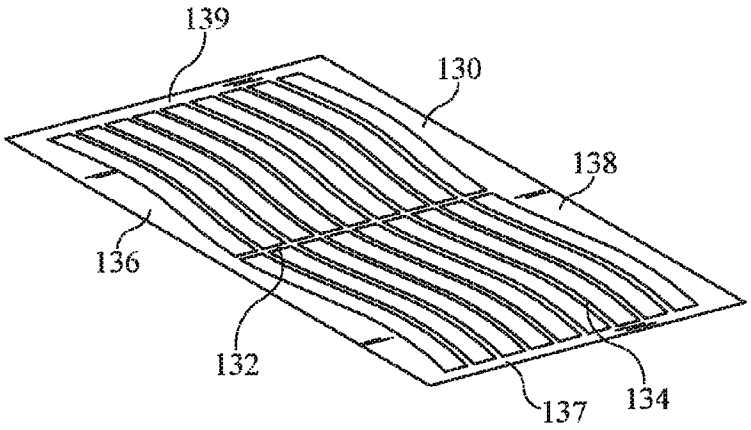
FIGS. 8A-8C show alternative examples of designs of the removable louver or lens holders of the present disclosure.
Figure 8C:
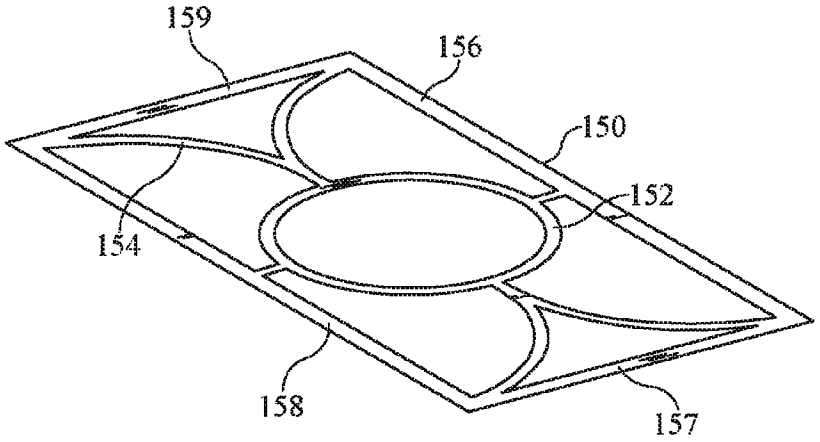
Figure 8B:
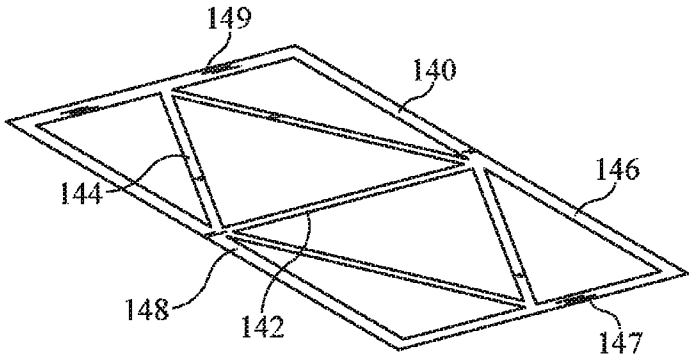

FIGS. 8A-8C show alternative examples of designs of the removable louver or lens holders of the present disclosure. Removable louver or lens holder 130 may have inwardly extending legs, for example cross-member 132, extending from a first side 136 to a second side 138. A plurality of wavy cross-members 134 may extend longitudinally from a third side 137 to a fourth side 139. The inwardly extending legs may be configured to form or hold a louver or lens. For example, cross-members 132 and 134 may form a louver incorporated with removable louver or lens holder 130 or may provide support and/or an aesthetic configuration for a lens, such as a diffuser, to be placed thereon.

Removable louver or lens holder 140 may have cross-member 142 extending from a first side 146 to a second side 148. A plurality of members 144 may extend from a third side 147 and a fourth side 149 to first and second sides 146 and 148. Members 142 and 144 may provide support and/or an aesthetic configuration for a lens, such as a diffuser, to be placed thereon.

Removable louver or lens holder 150 may have cross-member 152 extending from a first side 156 to a second side 158, with a circular design. A plurality of members 154 may extend from a third side 157 and a fourth side 159, to cross-member 152. Members 152 and 154 may provide support and/or an aesthetic configuration for a lens, such as a diffuser, to be placed thereon.

Lens support provided with the presently disclosed removable louver or lens holder may mitigate, or eliminate, deformation of the lens from the force of gravity and may aid in holding a lens with the removable louver or lens holder of the present disclosure. It is to be understood that there may be many and different designs made with members extending from the sides of the presently disclosed removable louver or lens holder and that the claims are not to be limited to any particular design. In at least one embodiment, the removable louver or lens holder of the present disclosure is void of members extending between its sides as the members may not be necessary to removably hold a louver or lens with the ceiling support grid.

A method of installing a removable louver or lens holder with a ceiling support grid is hereby disclosed. The method for installing a lens or louver with a ceiling support grid comprises the steps of transforming an outer perimeter of a louver or lens holder to a first outer perimeter, laying a portion of the first outer perimeter on a ceiling support grid, pivoting the lens or louver about the portion laid on the ceiling support grid and placing it substantially within a plane of the ceiling support grid, transforming an outer perimeter of the louver or lens holder to a second outer perimeter, and laying a portion of the second outer perimeter on the ceiling support grid and thereby hold the louver or lens to the ceiling support grid.

For example, the first outer perimeter may have at least one tab, or extended support arm, extending from a first side of the lens or louver, which may be laid on the ceiling support grid. The lens or louver may be pivoted about the at least one tab and placed substantially within a plane of the ceiling support grid. The louver or lens holder may be transformed to a second outer perimeter by extending at least one support arm, outwardly from a second side of the lens or louver. Lying the at least one support arm, extending from a second side of the lens or louver, on the ceiling support grid may hold the lens or louver solely with the ceiling support grid. In at least one embodiment, the at least one support arm may be extended outwardly from a second side of the lens or louver by rotating at least one locking mechanism.

There is thus provided a lighting system for a ceiling support grid comprising a removable louver or lens. One feature or aspect of an illustrative example is believed at the time of the filing of this patent application to possibly reside broadly in removable louver or lens holder 100, configured for holding a removable louver or lens 30 to a ceiling support grid, the removable louver or lens holder comprising: a rectangular or square frame having a first side 110 with a first side edge 111 and a second side 108 with a second side edge 107, wherein the first side edge and the second side edge are parallel with one another; at least one tab 104 extending from the first side edge; at least one locking mechanism 102 configured to have a portion extended from and retracted into the second side edge; wherein the at least one tab is configured and disposed to cooperate with the ceiling support grid 20 and removably hold the first side with the ceiling support grid; wherein the at least one locking mechanism is configured for passing the removable louver or lens holder into the ceiling support grid upon the at least one tab being cooperated with the ceiling support grid and the at least one locking mechanism being in the retracted position; and wherein the at least one locking mechanism is configured for holding the removable louver or lens holder with the ceiling support grid upon the at least one tab being cooperated with the ceiling support grid and the at least one locking mechanism being in the extended position.

Another feature or aspect of an illustrative example is believed at the time of the filing of this patent application to possibly reside broadly in the removable louver or lens holder of, wherein the at least one tab comprises a fixed tab extending from the first side edge.

Yet another feature or aspect of an illustrative example is believed at the time of the filing of this patent application to possibly reside broadly in the removable louver or lens holder, wherein the at least one locking mechanism comprises a retractable support arm 120/121 extending from the second side edge.

Still another feature or aspect of an illustrative example is believed at the time of the filing of this patent application to possibly reside broadly in the removable louver or lens holder of further comprising at least one removable louver or lens held between the first side edge 111 and the second side edge 107.

A further feature or aspect of an illustrative example is believed at the time of the filing of this patent application to possibly reside broadly in an the removable louver or lens holder comprising a third side 105 and a fourth side 106, wherein the first side, second side, third side, and fourth side each have the same cross-sectional configuration.

Another feature or aspect of an illustrative example is believed at the time of the filing of this patent application to possibly reside broadly in the removable louver or lens holder, wherein the first side, second side, third side, and fourth side each have their side edge extending perpendicular to the at least one removable louver or lens and a leg extending inwardly, 109 and 113 for example, from its side edge, holding the at least one removable louver or lens.

Yet another feature or aspect of an illustrative example is believed at the time of the filing of this patent application to possibly reside broadly in the removable louver or lens holder, wherein the at least one tab is configured and disposed to be placed between a lamp 10 and the ceiling support grid.

Still another feature or aspect of an illustrative example is believed at the time of the filing of this patent application to possibly reside broadly in the removable louver or lens holder, wherein the at least one locking mechanism is configured and disposed to have its support arm 120 to be extended between a lamp housing and the ceiling support grid.

A further feature or aspect of an illustrative example is believed at the time of the filing of this patent application to possibly reside broadly in the removable louver or lens holder, wherein the at least one locking mechanism comprises a retractable support arm configured to be rotated, "B" in FIG. 6, into and out of the extended position, 120 and 121.

Another feature or aspect of an illustrative example is believed at the time of the filing of this patent application to possibly reside broadly in the removable louver or lens holder, wherein the at least one locking mechanism comprises a shaft 118 extending from the retractable support arm 120 and through a leg extending inwardly 109 from the second side edge 107, the shaft having a slot 119 in the end extending through the inwardly extending leg and is configured to be rotated and to rotate the retractable support arm into the extended position, 120.

Yet another feature or aspect of an illustrative example is believed at the time of the filing of this patent application to possibly reside broadly in a method of installing a removable louver or lens holder with a ceiling support grid comprising the steps of: cooperating at least one tab extending from a first side edge of the removable louver or lens holder with the ceiling support grid; pivoting the removable louver or lens holder about the at least one tab and placing a second side edge of the removable louver or lens holder in or above a plane of the ceiling support grid; wherein the first and second side edges of the removable louver or lens holder are parallel with one another; extending at least one locking mechanism from the second side edge of the removable louver or lens holder; and wherein the step of extending the at least one locking mechanism from the second side edge of the removable louver or lens holder cooperates a support arm with the ceiling support grid and removably holds the removable louver or lens holder with the ceiling support grid.

One feature or aspect of an illustrative example is believed at the time of the filing of this patent application to possibly reside broadly a lighting system 1 for a ceiling support grid comprising: a luminaire; a removable louver or lens; a removable louver or lens holder, configured for holding the removable louver or lens to the ceiling support grid; the removable louver or lens holder comprising: a rectangular or square frame having a first side with a first side edge and a second side with a second side edge, wherein the first side edge and the second side edge are parallel with one another; at least one tab extending from the first side edge; at least one locking mechanism having a portion configured to be extended from and retracted into the second side edge; wherein the at least one tab is configured and disposed to cooperate with the ceiling support grid and removably hold the first side edge with the ceiling support grid; wherein the at least one locking mechanism is configured for passing the removable louver or lens holder into the ceiling support grid upon the at least one tab being cooperated with the ceiling support grid and the at least one locking mechanism being in the retracted position; and wherein the at least one locking mechanism is configured for holding the removable louver or lens holder with the ceiling support grid upon the at least one tab being cooperated with the ceiling support grid and the at least one locking mechanism being in the extended position.

Another feature or aspect of an illustrative example is believed at the time of the filing of this patent application to possibly reside broadly in the lighting system, wherein the at least one tab and the at least one locking mechanism have portions configured to extend outwardly from the removable louver or lens holder and be disposed between the ceiling support grid and the luminaire.

Yet another feature or aspect of an illustrative example is believed at the time of the filing of this patent application to possibly reside broadly in the lighting system, wherein the first side and second side of the removable louver or lens holder each have their side edges extending perpendicular to the removable louver or lens and a leg extending inwardly, 109 and 113, from its side edge, holding the at least one removable louver or lens.

Still another feature or aspect of an illustrative example is believed at the time of the filing of this patent application to possibly reside broadly in the lighting system, wherein the at least one locking mechanism comprises a retractable support arm configured to extend into and out of a slot opening 116 in the second side edge.

A further feature or aspect of an illustrative example is believed at the time of the filing of this patent application to possibly reside broadly in the lighting system, wherein the at least one locking mechanism comprises a shaft 118 extending from the retractable support arm 120 and through a leg extending inwardly 109 from the second side edge, the shaft having a slot 119 in the end extending through the inwardly extending leg and is configured to be rotated and to rotate the retractable support arm into and out of the extended position.

Another feature or aspect of an illustrative example is believed at the time of the filing of this patent application to possibly reside broadly in the lighting system, wherein the removable louver or lens holder comprises at least one cross-member 112 extending from its first side to its second side.

Yet another feature or aspect of an illustrative example is believed at the time of the filing of this patent application to possibly reside broadly in the lighting system, wherein the at least one cross-member extending from its first side to its second side has an aesthetic configuration.

Still another feature or aspect of an illustrative example is believed at the time of the filing of this patent application to possibly reside broadly in the lighting system, wherein the louver or lens is a light diffuser.

A further feature or aspect of an illustrative example is believed at the time of the filing of this patent application to possibly reside broadly in the lighting system, wherein the luminaire 10 has a troffer configured with edges configured and disposed to be placed upon the tabs and portions of the locking mechanism.

One feature or aspect of an illustrative example is believed at the time of the filing of this patent application to possibly reside broadly in a method for installing a lens or louver with a ceiling support grid comprising the steps of: laying at least one tab, extending from a first side of the lens or louver, on the ceiling support grid; pivoting the lens or louver about the at least one tab and placing it substantially within a plane of the ceiling support grid; extending at least one support arm, outwardly from a second side of the lens or louver; and laying the at least one support arm, extending from a second side of the lens or louver, on the ceiling support grid and thereby holding the lens or louver with the ceiling support grid.

Another feature or aspect of an illustrative example is believed at the time of the filing of this patent application to possibly reside broadly in a method for installing a lens or louver with a ceiling support grid of claim 9, wherein the extending at least one support arm, outwardly from a second side of the lens or louver, comprises rotating at least one locking mechanism.

Yet another feature or aspect of an illustrative example is believed at the time of the filing of this patent application to possibly reside broadly in a louver or lens holder configured to solely hold a louver or lens to a ceiling support grid and to transform its outer perimeter from a first outer perimeter to a second outer perimeter, wherein the first outer perimeter enables the louver or lens holder to fit into the ceiling support grid and the second outer perimeter enables the louver or lens holder to be held solely with the ceiling support grid.

Still another feature or aspect of an illustrative example is believed at the time of the filing of this patent application to possibly reside broadly in a louver or lens holder comprising: a rectangular or square frame having a first side edge and a second side edge, wherein the first side edge and the second side edge are parallel with one another; at least one extension extending from the first side edge; at least one retractable support arm configured to be extended from, and retracted into, the second side edge; wherein the louver or lens holder has the first outer perimeter upon the at least one support arm being retracted into the second side edge and the second outer perimeter upon the at least one support arm being extended from the second side edge.

A further feature or aspect of an illustrative example is believed at the time of the filing of this patent application to possibly reside broadly in a louver or lens holder, wherein the at least one extension is configured and disposed to rest on the ceiling support grid and wherein the at least one retractable support arm is configured to extend outwardly and to rest on the ceiling support grid and hold the louver or lens holder with the ceiling support grid.

Another feature or aspect of an illustrative example is believed at the time of the filing of this patent application to possibly reside broadly in a louver or lens holder, wherein the at least one extension and the at least one retractable support arm have portions configured to extend outwardly from the rectangular or square frame and to become disposed between the ceiling support grid and a luminaire or troffer.

Yet another feature or aspect of an illustrative example is believed at the time of the filing of this patent application to possibly reside broadly in a louver or lens holder, wherein the first side edge and second side edge extend perpendicular to a leg extending inwardly from its side edge, the inwardly extending legs being configured to form or hold a louver or lens and the at least one retractable support arm is configured to extend out of, and retract into, a slot opening in the second side edge.

Still another feature or aspect of an illustrative example is believed at the time of the filing of this patent application to possibly reside broadly in a louver or lens holder, wherein each of the at least one retractable support arm extends from a rotatable shaft extending through the inwardly extending leg, the shaft being configured to be rotated with the end extending through the inwardly extending leg and to rotate the retractable support arm to extend out of, and retract into, the slot opening in the second side edge.

A further feature or aspect of an illustrative example is believed at the time of the filing of this patent application to possibly reside broadly in a louver or lens holder comprising at least one cross-member extending from the first side edge to the second side edge.

Another feature or aspect of an illustrative example is believed at the time of the filing of this patent application to possibly reside broadly in a louver or lens holder comprising a louver or lens extending between the first side edge and the second side edge.

Yet another feature or aspect of an illustrative example is believed at the time of the filing of this patent application to possibly reside broadly in a louver or lens holder, wherein the louver or lens has a light diffuser.

One feature or aspect of an illustrative example is believed at the time of the filing of this patent application to possibly reside broadly in a louver or lens holder comprising at least two extensions extending from the first side edge and at least two retractable support arms configured to be extended from, and retracted into, the second side edge.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A removable louver or lens holder, configured for holding a louver or lens to a ceiling support grid;

the ceiling support grid comprising at least one rectangular or square grid opening with a first flange extending inward from a first side and a second flange extending inward from a second side, wherein the first flange and the second flange extend inward from a terminal longitudinally extending end of the ceiling support grid;

the removable louver or lens holder comprising:

a rectangular or square frame having a first side with a first side edge and a second side with a second side edge, wherein the first side edge and the second side edge are parallel with one another;

at least one flat tab extending from the first side edge and in a plane parallel with a plane of the louver or lens holder;

at least one locking mechanism configured to have a portion extended from the second side edge and in a plane parallel with the plane of the louver or lens holder, and retracted into the second side edge;

wherein the at least one flat tab has a first width adjacent the first side edge and a second width proximate its extended end, the second width being approximately equal to the first width and is configured and disposed to lay on the first flange of the ceiling support grid and removably hold the first side with the ceiling support grid;

wherein the at least one locking mechanism is configured for passing the removable louver or lens holder into the ceiling support grid, through the at least one rectangular or square grid opening, upon the at least one tab being laid on the first flange of the ceiling support grid and the at least one locking mechanism being in the retracted position; and wherein the at least one locking mechanism is configured for holding the removable louver or lens holder with the ceiling support grid upon the at least one tab being laid on the first flange of the ceiling support grid and the at least one locking mechanism being in the extended position and laid on the second flange of the ceiling support grid.

2. The removable louver or lens holder of claim 1, wherein the at least one tab comprises a fixed tab extending from the first side edge.

3. The removable louver or lens holder of claim 1, wherein the at least one locking mechanism comprises a retractable support arm configured to extend from the second side edge.

4. The removable louver or lens holder of claim 3, wherein the at least one tab and the at least one retractable support arm are configured to be inserted between a troffer and the first and second flange of the ceiling support grid and have the troffer rest on the at least one flat tab.

5. The removable louver or lens holder of claim 1 further comprising a louver or lens held between the first side edge and the second side edge.

6. The removable louver or lens holder of claim 4 having a third side and a fourth side, wherein the first side, second side, third side, and fourth side each have a side edge extending perpendicular to the at least one louver or lens and a leg extending inwardly from its side edge, holding the at least one louver or lens.

7. The removable louver or lens holder of claim 1, wherein the at least one locking mechanism comprises a retractable support arm configured to be rotated into and out of the extended position.

8. The removable louver or lens holder of claim 7, wherein the at least one locking mechanism comprises a shaft extending from the retractable support arm and through a leg extending inwardly from the second side edge, the shaft having a slot in the end extending through the inwardly extending leg and is configured to be rotated and to rotate the retractable support arm into the extended position.

9. A method for installing a lens or louver with a ceiling support grid having a troffer comprising the steps of:

inserting at least one fixed flat tab, extending from a first side of the lens or louver, between the troffer and the ceiling support grid and resting the at least one fixed flat tab on the ceiling support grid;

pivoting the lens or louver about the at least one tab and placing it substantially within a plane of the ceiling support grid;

extending at least one support arm, outwardly from a second side of the lens or louver and between the troffer and the ceiling support grid; and laying the at least one support arm, extending from a second side of the lens or louver, on the ceiling support grid and thereby holding the lens or louver with the ceiling support grid and having the troffer laying directly on the at least one fixed flat tabs and the at least one support arm.

10. The method for installing a lens or louver with a ceiling support grid of claim 9, wherein the step of extending at least one support arm, outwardly from a second side of the lens or louver, comprises rotating at least one locking mechanism and extending the support arm through a slot opening in a second side edge wall.

11. A louver or lens holder configured to solely hold a louver or lens to a ceiling support grid and to transform its outer perimeter from a first outer perimeter to a second outer perimeter, the ceiling support grid comprising at least one rectangular or square grid opening with a first flange extending inward from a first side and a second flange extending inward from a second side, wherein the first flange and the second flange extend inward from a longitudinally extending terminal end of the ceiling support grid;

wherein the first outer perimeter has at least one fixed flat extension and enables the louver or lens holder to fit into the ceiling support grid and have the at least one fixed flat extension rest on the first flange, the second outer perimeter enables the louver or lens holder to cooperate with the second flange and to be held solely with the ceiling support grid;

wherein each of the at least one fixed flat extension has a first width adjacent the first side edge and a second width proximate its extended end, the second width being approximately equal to the first width.

12. The louver or lens holder of claim 11 comprising:

a rectangular or square frame having a first side edge and a second side edge, wherein the first side edge and the second side edge are parallel with one another and the at least one flat extension extends from the first side edge;

at least one retractable support arm configured to be extended from, and retracted into, the second side edge;

wherein the louver or lens holder has the first outer perimeter upon the at least one support arm being retracted into the second side edge and the second outer perimeter upon the at least one support arm being extended from the second side edge.

13. The louver or lens holder of claim 12 wherein the at least one extension is configured and disposed to rest on the ceiling support grid and wherein the at least one retractable support arm is configured to extend outwardly and to rest on the ceiling support grid and hold the louver or lens holder with the ceiling support grid.

14. The louver or lens holder of claim 13, wherein the at least one extension and the at least one retractable support arm have portions configured to extend outwardly from the rectangular or square frame and to become disposed between the ceiling support grid and a luminaire or troffer.

15. The louver or lens holder of claim 14, wherein the second side edge comprises a wall, a leg inwardly extends perpendicular to the second side edge wall, the inwardly extending leg being configured to form or hold a louver or lens and the at least one retractable support arm is configured and disposed to extend out of, and retract into, a slot opening in the second side edge wall.

16. The louver or lens holder of claim 12 comprising at least one cross-member extending from the first side edge to the second side edge.

17. The louver or lens holder of claim 12 comprising a louver or lens extending between the first side edge and the second side edge.

18. The louver or lens holder of claim 17, wherein the louver or lens has a light diffuser.

19. The louver or lens holder of claim 12 comprising at least two extensions extending from the first side edge and at least two retractable support arms configured to be extended from, and retracted into, the second side edge.

20. A louver or lens holder configured to solely hold a louver or lens to a ceiling support grid and to transform its outer perimeter from a first outer perimeter to a second outer perimeter, the ceiling support grid comprising at least one rectangular or square grid opening with a first flange extending inward from a first side and a second flange extending inward from a second side, wherein the first flange and the second flange extend inward from a longitudinally extending terminal end of the ceiling support grid;

wherein the first outer perimeter has at least one fixed flat extension and enables the louver or lens holder to fit into the ceiling support grid and have the at least one fixed flat extension rest on the first flange, the second outer perimeter enables the louver or lens holder to cooperate with the second flange and to be held solely with the ceiling support grid, the louver or lens holder comprising:

a rectangular or square frame having a first side edge and a second side edge, wherein the first side edge and the second side edge are parallel with one another and the at least one flat extension extends from the first side edge;

at least one retractable support arm configured to be extended from, and retracted into, the second side edge;

wherein the louver or lens holder has the first outer perimeter upon the at least one support arm being retracted into the second side edge and the second outer perimeter upon the at least one support arm being extended from the second side edge;

wherein the at least one extension is configured and disposed to rest on the ceiling support grid and wherein the at least one retractable support arm is configured to extend outwardly and to rest on the ceiling support grid and hold the louver or lens holder with the ceiling support grid;

wherein the second side edge comprises a wall, a leg inwardly extends perpendicular to the second side edge wall, the inwardly extending leg being configured to form or hold a louver or lens and the at least one retractable support arm is configured and disposed to extend out of, and retract into, a slot opening in the second side edge wall; and wherein each of the at least one retractable support arm extends from a rotatable shaft extending through the inwardly extending leg, the shaft being configured to be rotated with the end extending through the inwardly extending leg and to rotate the retractable support arm to extend out of, and retract into, the slot opening in the second side edge wall.

* * * * *